US010329003B2

(12) United States Patent
Scarselli

(10) Patent No.: US 10,329,003 B2
(45) Date of Patent: Jun. 25, 2019

(54) INTEGRAL SAIL AND CORRESPONDING METHOD OF PRODUCTION

(71) Applicant: G.B.L. FIDUCIARIA S.P.A., Milan (IT)

(72) Inventor: Stefano Scarselli, Empoli (IT)

(73) Assignee: G.B.L. FIDUCIARIA S.P.A., Milan (IT)

( * ) Notice: Subject to any disclaimer, the term of this patent is extended or adjusted under 35 U.S.C. 154(b) by 632 days.

(21) Appl. No.: 14/442,685

(22) PCT Filed: Nov. 13, 2013

(86) PCT No.: PCT/IB2013/002525
§ 371 (c)(1),
(2) Date: May 13, 2015

(87) PCT Pub. No.: WO2014/076540
PCT Pub. Date: May 22, 2014

(65) Prior Publication Data

US 2016/0280349 A1 Sep. 29, 2016

(30) Foreign Application Priority Data

Nov. 13, 2012 (IT) ..... UD2012A0190

(51) Int. Cl.
*B63H 9/06* (2006.01)

(52) U.S. Cl.
CPC ... *B63H 9/0657* (2013.01); *B63H 2009/0678* (2013.01)

(58) Field of Classification Search
CPC ..... B63H 2009/0678; B63H 9/0657; B63H 9/06; B63H 9/04; B63H 200/0678;
(Continued)

(56) References Cited

U.S. PATENT DOCUMENTS 4,679,519 A 7/1987 Linville
4,945,848 A * 8/1990 Linville ..... B32B 27/12 114/102.31

(Continued)

FOREIGN PATENT DOCUMENTS

EP 0475083 A1 3/1992
EP 1114771 A1 7/2001

(Continued)

OTHER PUBLICATIONS

International Search Report and Written Opinion of the International Searching Authority for PCT/IB2013/002525 dated Feb. 21, 2014.

*Primary Examiner* — Camie S Thompson
(74) *Attorney, Agent, or Firm* — Marshall, Gerstein & Borun LLP

(57) ABSTRACT

An integral sail to generate a propulsion following a thrust from the wind has an integral layered structure delimited externally by a first external layer and by a second external layer, both made with a smooth layer of thin and continuous film of flexible material. Furthermore, to each of said first external layer and second external layer at least a layer of parallel fibers, adjacent to each other, is associated internally with respect to the layered structure. The whole is made solid by means of at least a layer of thermofusible glue, disposed inside the external layers and in coordination with the corresponding layers of parallel fibers.

21 Claims, 2 Drawing Sheets

(58) Field of Classification Search
CPC .. B32B 5/22; B32B 5/08; B32B 27/12; B32B 7/00; B32B 2250/20; B32B 2250/24; B32B 2605/12; B32B 7/12; Y10T 428/24099; A63H 27/08
USPC ... 114/102.29, 102.31–102.33, 102.1, 102.3; 428/110, 36.9, 213; 73/170.15; 442/255; 244/153 R; 180/65.31
See application file for complete search history.

(56) References Cited

U.S. PATENT DOCUMENTS

| | | | | |
|---|---|---|---|---|
| 6,302,045 | B1 | 10/2001 | Mahr | |
| 2007/0256621 | A1* | 11/2007 | Fiorenzi ..... | B63H 9/06<br>114/102.29 |

FOREIGN PATENT DOCUMENTS

| | | | |
|---|---|---|---|
| EP | 1944232 | A2 | 7/2008 |
| WO | WO-94 11185 | A1 | 5/1994 |
| WO | WO-2004041636 | A1 | 5/2004 |
| WO | WO-2008 071729 | A1 | 6/2008 |

* cited by examiner

INTEGRAL SAIL AND CORRESPONDING METHOD OF PRODUCTION

FIELD OF THE INVENTION

The present invention concerns a sail, in particular an integral sail, used both for nautical activities and for other activities that use the energy of air currents as a driving force.

The present invention also concerns the method to produce the sail and the means that are needed to execute the method.

BACKGROUND OF THE INVENTION

Sails for vessels are known, in particular but not exclusively cruise sails and regatta sails, which use the kinetic energy of the wind or canalizations thereof to confer a propulsive thrust to said vessels.

Sails are normally bent to a mast and cooperate with a boom at the base, or are bent or cooperate with a mainstay. They are normally obtained by putting together sailcloths according to various theories or practical embodiments.

Sails that are known and seen in nautical activities, unless they are small size sails for windsurfing, all have at least an overlap line, in which two parts or sailcloths of a sail are stably joined together.

The overlap line, especially where the nautical activity has to exploit to the utmost the thrusting action of the wind, entails poorer performance, although limited.

It is therefore a disadvantage of this type of known sail, as used in cruise and regatta vessels, that the overlap lines contradict the content of the patents that should protect said sails, but in practice give valid results only on paper.

Furthermore, one problem of known sails as used in cruise and regatta vessels that arises in nautical activity is the continuity of the surface. This is a performance factor, and even small discontinuities, creating small vortexes, create an overall drop in performance of the sail. Such discontinuities can be created, for example, by the conformation of the material used, or by air bubbles trapped in the resin or glue that makes up the surface on which the wind flows. In order to eliminate the loss in performance that these discontinuities entail, it is therefore necessary, for example in a regatta, to try, obsessively and painstakingly, to recover each and every feature that can give even a minimally better performance.

Another disadvantage of known sails as used in cruise and regatta vessels is the construction of the sail in terms of strength and cost, especially where complex machines have to be used to make the sail and where, apart from the complex machines, the sail then has to be completed manually (for example by overlapping segments of sail).

Apart from the uncertainties of the auxiliary human intervention, the costs of such a sail increase, reducing the possibility of access to such high performance sails.

There is also the factor of strength (and conformation) of the sails: it is well known that sails are studied and made according to precise ranges of specific winds.

Document EP-A-1.114.771 describes a composite material for making a sail, comprising a pair of thin polymer films, suitable to obtain a sandwich inside which a layer is inserted, consisting of a two- or three-dimensional mesh. The known composite material also provides two layers of individual fibers, not parallel and mutually intersecting, disposed on each face of the mesh, each in direct contact with a respective flexible polymer film. The layers are bound to the mesh and the respective flexible films by means of a glue, and by carrying out a calendering operation.

Document U.S. Pat. No. 6,302,045 (US'045) describes a molded three-layer sail, obtained by rolling together three reinforced triangular layers of film in a mold. Each triangular layer is designed for a respective corner of the sail, that is, tack corner, head corner and clew corner. Each layer consists of a plurality of triangular parts that start from a respective one of the three corners of the sail, so that the parts in each layer overlap in the body of the sail. Each triangular layer includes a plurality of primary reinforcement elements in the form of threads, attached to one side of a film by means of a layer of adhesive applied to the film. These reinforcement elements in the form of threads run parallel to and distanced from each other, parallel to a long side, from the peak of the triangle. Possibly, additional transverse reinforcement threads or elements may also be present. With the construction proposed in US'045, the parallel reinforcement threads of each triangular layer are transverse and intersect with the threads of the other triangular layers, because the threads run from a respective peak of the triangular layer, which for the three triangular layers will be respectively the tack corner, the head corner and the clew corner, which cannot overlap.

The present invention therefore has a plurality of aims and purposes, all suitable to overcome the limits of the state of the art as identified above, and also to give other advantages as will be evident in the following description.

It is therefore one purpose of the present invention to obtain a truly integral sail, that is, without external overlapping of two or more important parts of the sail.

It is also a purpose of the present invention to obtain a sail having a smooth surface on both sides and hence without discontinuities, even small ones, created by possible air bubbles or other in the material (resin or glue) that makes up the surface on which the wind flows.

It is also a purpose of the invention to obtain sails suitable to be used in a range of winds, also comprising very fast winds.

Another purpose of the present invention is to perfect a method that allows to obtain sails with operative continuity, simply and fast.

It is also a purpose to obtain sails having a profile suitable both for the type of sailing for which they are designed, and also for the type of wind for which they are made.

The Applicant has devised, tested and embodied the present invention to overcome the shortcomings of the state of the art and to obtain these and other purposes and advantages.

SUMMARY OF THE INVENTION

The purposes and advantages which will be made clear hereafter, and also others, are obtained by a sail and a respective method for obtaining said sail according to the main claims. The connected dependent claims protect variants of or improvements to the main idea.

In accordance with the above purposes, a sail according to the present invention is created so as to have on each of its two faces on which the wind flows a smooth or substantially smooth layer, with a film or consisting of a thin continuous film of flexible material, for example polymer, in particular plastic polymer, which can be rolled or extruded, or spread or sprayed, which constitutes the interface in contact with the wind.

According to some forms of embodiment of the present invention, the layer of thin and continuous film of flexible material can weigh from 15 g/m2 to 50 g/m2, advantageously between 18 g/m2 and 35 g/m2.

Applicant has found that this selection in the specified range of weight of the thin and continuous film of flexible material can determine an advantageous and surprising technical effect in terms of strength and resistance to atmospheric agents, indeformability and containing the weight of the integral sail described here.

Between the two layers of continuous film thus provided, which make up the more external layers of the layered structure which makes up the sail, two or more layers of fibers are provided, parallel and adjacent, of resistant material, such as for example aramid fibers, for example Kevlar®, or polyethylene fibers, for example UHMWPE, modified polyethylene, glass, polyester or carbon fibers, or mixed fibers, for example of those listed here, to compensate for the deficiencies of one material or the other.

According to some forms of embodiment described here, at least one of the first layers of parallel fibers cooperating with a first external layer of film provides its fibers disposed parallel also to the fibers of at least another layer of parallel fibers cooperating with said first external layer of film or with a second external layer of film.

In one form of embodiment, the fibers are disposed parallel to the base, so as to contain horizontal tensions.

According to a variant, the fibers are disposed parallel to the leech or luff, in order to contain the vertical tensions.

According to another variant the fibers are positioned oriented toward the center of load of the sail, so as to contain the tensions due to radial thrusts that start from said center.

According to a variant, the fibers are disposed according to the two variants indicated above in order to contain the tensions in a compound form.

In an intermediate position reinforcement fibers are disposed, individually or in adjacent groups, which serve to reinforce the sail according to the composite lines of force that are generated on the surface of the sail.

In the case of split fibers, the invention provides that the structural continuity is obtained by partial overlapping thereof.

According to the invention, in cooperation with the respective external layer and the parallel fibers that cooperate with it, at least one layer of thermofusible glue is provided.

The thermofusible material can be put between external layer and layer/layers of parallel fibers, or put in cooperation only with the layer/layers of parallel fibers, or again a combination of these positions.

In this way two stratified semi-components are obtained, each comprising an external layer, at least one layer of thermofusible glue and a layer, or several layers, of parallel adjacent fibers. By combining the stratified semi-components, between which the reinforcement fibers are interposed, a semi-worked piece of the layered structure is obtained, which takes the name of multilayer sandwich.

The integral sail according to the present invention is obtained by subjecting the multilayer sandwich to pressure and heating. The heating operation is intended to melt the layer or layers of thermofusible glue, so as to bind together the components comprised between the two external sheets or layers.

In order to confer on the integral sail the desired wing shape, the method according to the invention provides to generate to one side a mother sail, having the desired internal profile, onto which the multilayer sandwich is positioned before it is subjected to pressure and heating.

The mother sail can have any shape whatsoever, for example flat and planar or shaped according to the specific requirements of use.

To facilitate obtaining the wing profile, the bundles of parallel fibers can be positioned according to the individual curves that they must possess when the sail is complete.

In order to subject the sail to the desired pressure and heating, the mother sail is inserted, after the multilayer sandwich has been positioned on top of it, inside a watertight sack.

Then, a vacuum is created inside the watertight sack and subsequently the whole thing is heated.

In this way an integral sail is obtained, in a single body, flexible and light, which achieves all the intended purposes and others again.

BRIEF DESCRIPTION OF THE DRAWINGS

These and other characteristics of the present invention will become apparent from the following description of some forms of embodiment, given as a non-restrictive example with reference to the attached drawings wherein.

DETAILED DESCRIPTION OF SOME FORMS OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

With reference to the attached drawings, a sail 10 according to the present invention has a layered structure comprising two external layers, first 11 and second 111, comprising a thin film that includes polymer material, in particular polymer plastic, for example polypropylene or polycarbonate or other material suitable for the specific purpose required on each occasion.

In possible forms of embodiment, which can be combined with all the forms of embodiment described here, the two external layers, first 11 and second 111, can be formed by fibers, or by rolled material or net reinforced with nonwoven fabric, for example spread or sprayed. For example, the fibers can be chosen from a group comprising fibers of: carbon, aramid, for example Kevlar®, polyethylene, for example UHMWPE, modified polyethylene, glass, polyester or mixes thereof.

The base material of the external layers, first 11 and second 111, can be protected by lining them with a polymer material, in particular polymer plastic, which can for example be spread or sprayed, such as, as mentioned above, polypropylene or polycarbonate or other material suitable for the specific purpose required on each occasion. In particular, the material that is used for protection is provided to guarantee strength against abrasion and to protect against atmospheric factors harmful to the preservation of the sail.

The layered structure is obtained from a multilayer semi-worked piece or sandwich 20, which is subjected to pressing and heating.

Figure 3:
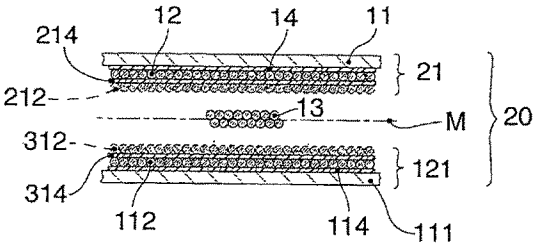
FIG. 3 shows the pre-disposition of the semi-components to obtain a multilayer sandwich from which the layered structure in FIG. 1 is obtained.

In the case shown here, the sandwich 20 is defined, by way of example, by two semi-components 21, 121, which in this case are reciprocally symmetrical and specular with respect to a median line M of the sandwich 20 (FIG. 3).

It must be remembered that if it is necessary to contrast behaviors of the vessel, or in the case of particular regattas, the two semi-components 21, 121 may not have the same composition.

In this case, on the surface of each external layer 11, 111 which, when the sail 10 is complete, will face toward the inside of the sandwich 20, a first layer of thermofusible glue 14, 114 is applied, by depositing a film of material or by spraying.

On each first layer of thermofusible glue 14, 114 a first layer of parallel fibers 12, 112 is put. The fibers of each of the first layers of parallel fibers 12, 112 are disposed parallel with respect to each other, that is, one-directional, without crossing, and are disposed adjacent to each other according to a predetermined orientation on the basis of the direction of the tensions or thrusts or loads that they have to support. In particular, each first layer of parallel fibers 12, 112 can be considered a panel of one-directional fabric formed by the parallel and adjacent fibers. In possible implementations, the fibers of each first layer of parallel fibers 12, 112 are not only parallel but are also adjacent directly in contact with each other, therefore essentially without providing reciprocal interspaces.

According to some forms of embodiment, which can be combined with all the forms of embodiment described here, at least a first layer of parallel fibers 12 cooperating with the first external layer 11 provides its fibers not only parallel with respect to each other as described above, but also disposed parallel to the fibers of another first layer of parallel fibers 112 cooperating with the second external layer 111.

According to a variant, on each first layer of parallel fibers 12, 112 a second layer of thermofusible glue 214, 314 can be deposited.

Several layers of parallel fibers, also differently oriented, can also be provided.

It also comes within the spirit of the invention to provide only the second layers of thermofusible glue 214, 314, without the first layers of thermofusible glue 14, 114 disposed between corresponding pairs comprising an external layer 11, 111 and the contiguous first layer of parallel fibers 12, 112.

In this way two semi-components 21, 121 are created, each defined by an external layer (11 or 111), by at least one layer of parallel fibers (12, 112, 212, 312) and by at least one layer of thermofusible glue (14, 114, 214, 314).

In correspondence with the median zone of the sandwich 20 (FIGS. 3 and 4), reinforcement fibers 13 are positioned, suitable to contain the lines of force and tensions which, in use, are generated on the surface of the sail 10 under the thrusting action of the wind.

In this case, the shape of the sandwich 20 is defined by the two semi-components 21, 121 and by the reinforcement fibers 13, interposed between them.

The reinforcement fibers 13 can be organized in continuous bands or strips, and can define a whole layer of the sandwich 20, or only parts of it.

For example, the reinforcement fibers 13 can be provided distributed in reinforcement layers, at intervals with respect to the layer of parallel fibers 12, 112, 212, 312.

Furthermore, reinforcement fibers 13 of one specific reinforcement layer can be all parallel to each other. Moreover, reinforcement fibers 13 of one reinforcement layer can be parallel to reinforcement fibers of another reinforcement layer.

Furthermore, in possible alternative implementations, the reinforcement fibers 13 can be configured crossed, in a reinforcement mesh or grid.

The reinforcement fibers 13 can be uninterrupted, or formed by segments.

Figure 1:
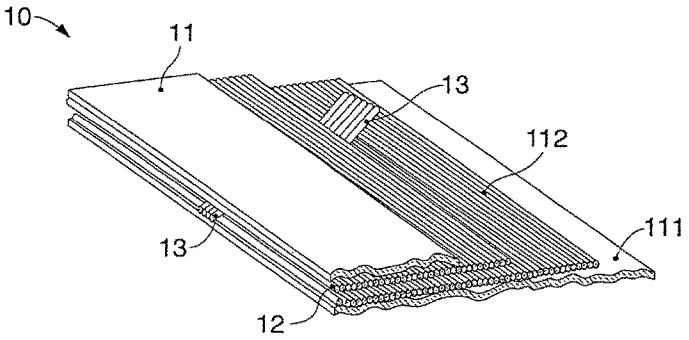
FIG. 1 shows an example, in section, of the layered structure of an integral sail made according to the present invention.
Figure 2:
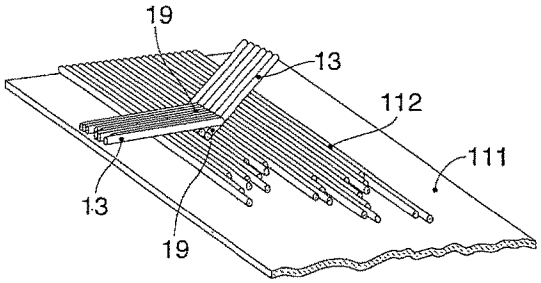
FIG. 2 shows an example of how to dispose reinforcement fibers that are used to contain composite lines of force.

If segments of reinforcement fibers 13 are used (FIG. 2), they will be provided overlapped in their incident terminations 19.

If one semi-component 21, 121 comprises other layers of parallel fibers apart from the first layer of parallel fibers 12, 112, such layers (that is, second layers of parallel fibers 212, 312, shown by dashes in FIG. 3, and others, not shown in the drawings) can all be oriented in the same direction, or at least one of the other layers of parallel fibers can be oriented in a different direction, so as to contain tensions different from those contained by the first layer of parallel fibers 12, 112 of the respective semi-component 21, 121.

To give the desired shape to the sail 10, as required by its size and by the range of winds that it must support, it is possible to deposit the layers of parallel fibers 12, 112 on corresponding first 11 and second 111 external layers, taking this into account.

When the sandwich 20, which in FIG. 3 is shown in an intermediate condition during the production of the sail 10, is subjected to pressure and heating, a single element is obtained in which the glue material of each layer of thermofusible glue 14, 114, 214, 314, as it melts, invades all the interstices of the layers of the sandwich 20, binding the latter in a structure with a single integral body (FIG. 4 and enlarged detail of FIG. 4, considering, to ensure a better comprehension, that the proportions might not be respected), that is, without external discontinuities.

To apply the desired pressure on the sandwich 20, which together with said heating produces the integral body cited above, the method to make the sail 10 provides to use a mother sail 15 having a profile and shaping mating with those of the finished sail 10.

After the sandwich 20 as described above has been prepared, during which time the final or almost final shape of the sail 10 is conferred upon it, the sandwich 20 itself is deposited on the mother sail 15.

Figure 5:
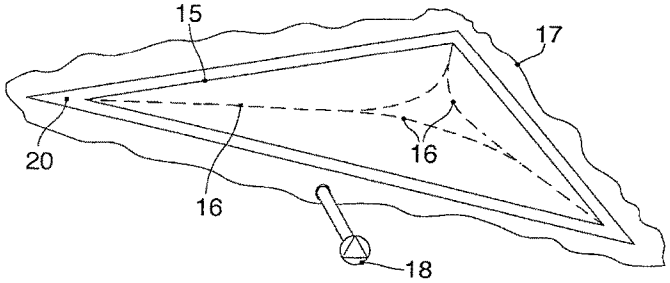
FIG. 5 shows how the pressure is applied and how the sail in FIG. 1 is shaped.

The latter can be a flattened plane shape or shaped and have shaping lines 16 (FIG. 5), which create the desired spatial conformation that the sail 10 will have once completed.

At this point, the mother sail 15 on which the sandwich 20 is positioned, still in a state where its components are in practice disposed in the desired manner but substantially not subject to reciprocal constraints, or subject to weak constraints, is inserted inside a watertight sack 17.

By means of a pump 18, the air inside the watertight sack 17 is aspirated, to create inside it a depression and subject it to a vacuum condition.

The depression thus determined creates a desired and intense pressure, in practice distributed uniformly on the surfaces that make up the sandwich 20, which adheres to the mother sail 15 to assume the desired conformation thereof.

At the same time, the watertight sack 17 is hit with hot air, or heated steam, at a temperature such as to determine a substantially uniform heating of the sandwich 20 and sufficient to melt the glue of the layers of thermofusible glue 14, 114, 214, 314 and make it migrate.

As well as with hot air hitting the watertight sack 17, heating can be carried out in other ways too: for example it may be provided that the watertight sack 17 has electric resistances which when activated give heat to the content of the watertight sack 17.

The melted glue material, once everything has cooled, allows to generate an integral body as described above.

Furthermore, the integral body that makes up the sail 10 has smooth external surfaces, without even the slightest imperfection, discontinuity of material or depressions at any point.

Figure 6:
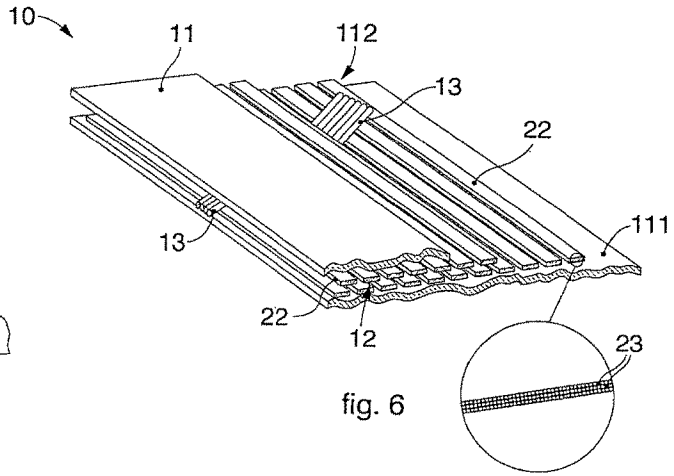
FIG. 6 shows an example, in section, of a variant form of embodiment of the layered structure of an integral sail made according to the present invention.
Figure 7:
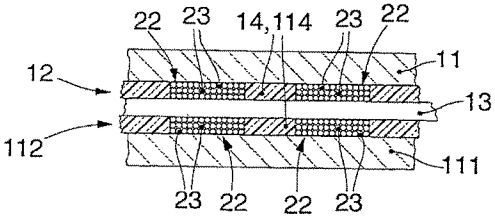
FIG. 7 shows the sandwich after the pressure and heating operations according to the variant form of embodiment in FIG. 6.

FIGS. 6 and 7, in which the proportions of the components might not be respected, to ensure a better comprehension, are used to describe forms of embodiment where the fibers of each layer of parallel fibers 12, 112, 212, 312 are organized and grouped together in threads that define a plurality of strips or bands according to a desired, repeatable and modular conformation. In particular, according to some forms of embodiment described here, each layer of parallel fibers 12, 112, 212, 312, instead of consisting of a panel of one-directional fabric formed by said parallel fibers, can be formed by a plurality of strips or bands of one-directional and parallel fibers 22 disposed parallel and adjacent to each other, which in particular can be for example at intervals or reciprocally distanced by a predefined interspace, or separation, which can be constant or different between the different strips 22.

In particular, the strips of one-directional and parallel fibers 22 can be laid or deposited above the two external layers, first 11 or second 111, and subsequently the integral sail 10 can be made as described above.

In some forms of embodiment described here, the strips of one-directional and parallel fibers 22 can be disposed adjacent to an interspace or separation, which can be chosen between 0 mm and 20 mm. It is not excluded that some strips of one-directional and parallel fibers 22 can also be adjacent to and in contact with each other during the depositing and laying process.

In some possible implementations, the strips of one-directional and parallel fibers 22 can extend uninterrupted from one side of the sail to the other, from one end to the other and from one corner to the other.

In possible implementations, the strips of one-directional and parallel fibers 22 can be formed of a synthetic material, in particular chosen from a group comprising: carbon, aramid, for example Kevlar®, polyethylene, for example UHMWPE, modified polyethylene, glass, polyester In particular, the strips of one-directional and parallel fibers 22 can be formed in turn of one-directional and parallel threads 23 consisting of fibers of the material as above (see for example the enlarged detail in FIG. 6, considering that, to ensure a better comprehension, the proportions might not be respected), said threads 23 having a much smaller diameter than that of the one-directional fibers of the layers of parallel fibers 12, 112, 212, 312 described using for example FIGS. 1-5.

In possible forms of embodiment, the threads 23 that make up the cited strips of one-directional and parallel fibers 22 can be disposed adjacent directly in contact with each other, without interspaces or intervals.

In some forms of embodiment described here, the strips of one-directional and parallel fibers 22 can have a width that can be chosen between 5 mm and 50 mm, for example from 9 mm to 16 mm as explained by way of example hereafter. For example, each of the strips of one-directional and parallel fibers 22 can be obtained from individual yarns, each consisting of said threads 23. For example, it is possible to use individual yarns, for example each from 1000 to 5000 dtex (decitex), for example 4000 dtex. In particular, each of the individual yarns that can be used can have a diameter or width for example from 3 mm to 7 mm.

As an example of a possible spread ratio, it may be indicated that, starting from a carbon filament of 4000 dtex and 3 mm wide, this can be spread to obtain a strip with a width in a range for example from 9 mm to 16 mm.

To obtain the strips of one-directional and parallel fibers 22, each individual yarn as above is opened, that is, singularized in the threads that make it up, and widened or spread, so as to give the desired width of the strips of one-directional and parallel fibers 22 as above.

In possible forms of embodiment, the threads 23, once the yarn has been opened and spread, can be provided on several overlapping planes, for example 2 or 3 planes of overlapping threads, one-directional and parallel, as described for example with reference to the enlarged detail in FIG. 6. This can be obtained by properly carrying out the process of singularizing and spreading the individual yarn as above. As another possibility, it may also be provided that the threads of the yarn opened to define the strips of one-directional and parallel fibers 22 are all on the same plane, always one-directional and parallel.

We maintain that the strips of one-directional and parallel fibers 22 described here essentially obtain the bearing structure of the sail in question, reinforcing the body of the sail, and can be positioned three-dimensionally above one of the two external layers, first 11 or second 111. The other of the two layers 111, 11 will in turn be positioned above the strips of one-directional and parallel fibers 22, oriented according to the needs of each individual sail.

Figure 4:
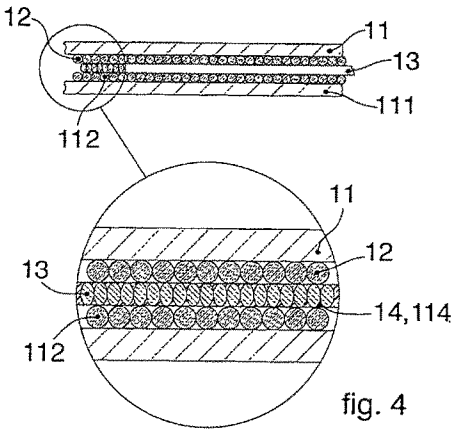
FIG. 4 shows the sandwich in FIG. 3 after the pressure and heating operations.

Also in the forms of embodiment described using FIGS. 6 and 7 it can be provided to use one or more layers of thermofusible glue 14, 114, 214, 314 which, when they melt, bind the various components described above, defining a structure in a single and integral body, as already described for example with reference to FIG. 4 and the respective enlarged detail.

In possible forms of embodiment, the strips of one-directional and parallel fibers 22 have a limited thickness, that is, they are very thin. In particular, the strips of one-directional and parallel fibers 22 are so thin that they allow the glue of the layers of thermofusible glue 14, 114, 214, 314 to penetrate through them, passing through the interstices between the threads and fibers that make them up, advantageously filling them, so as to obtain the desired sandwich structure in a single body.

The forms of embodiment described in particular using FIGS. 6 and 7 make the sail even more indeformable, at the same time considerably limiting the weight, to the greater advantage, for example, of performance.

Figure 8:
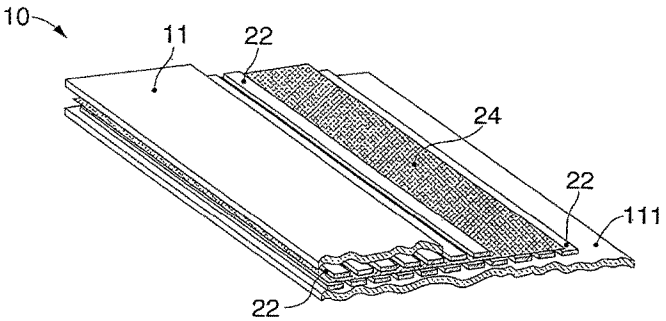
FIG. 8 shows an example, in section, of another variant form of embodiment of the layered structure of an integral sail made according to the present invention.

In possible forms of embodiment described using for example FIG. 8, which can be combined with all the forms of embodiment described here, the internal structure of the sail can be integrated with one or more meshes or nets 24, advantageously reinforced with nonwoven fabric, for example spread, or other fibers, woven, overlapped or distributed in a directioned or statistical manner. This possible form of embodiment with one or more meshes or nets 24 can be combined both with forms of embodiment described using FIGS. 1-5, and therefore with layers of parallel fibers 12, 112, 212, 312 formed by adjacent and parallel fibers, and also with forms of embodiment described using FIGS. 6 and 7, and therefore with layers of parallel fibers 12, 112, 212, 312 formed by strips 22, providing in combination the presence of reinforcement fibers 13, and also one or more layers of thermofusible glue 14, 114, 214, 314.

In some forms of embodiment, which can be combined with all the forms of embodiment described here, a mesh or net 24 as described above can be provided to function as the mother sail 15 in the method of production as described above. Essentially, therefore, the mesh or net 24 can be used as a mold or form to construct the sail according to the present description and, at the end, remains an integrating part of the body of the sail.

It is clear that modifications and/or additions of parts may be made to the sail 10 and the corresponding production method as described heretofore, without departing from the field and scope of the present invention.

It is also clear that, although the present invention has been described with reference to some specific examples, a person of skill in the art shall certainly be able to achieve many other equivalent forms of integral sail, having the characteristics as set forth in the claims and hence all coming within the field of protection defined thereby.

The invention claimed is:

1. Integral sail to generate a propulsion following a thrust from the wind, comprising: an integral layered structure delimited externally by a first external layer and by a second external layer, both made with a smooth layer of thin and continuous film of flexible material, and in that to each of said first external layer and second external layer at least a first layer of parallel fibers, adjacent to each other, is associated internally with respect to said layered structure, wherein at least the first layer of parallel fibers cooperating with the first external layer provides its fibers disposed parallel also to the fibers of another layer of parallel fibers cooperating with the first external layer and parallel to the fibers of the first layer of parallel fibers cooperating with the second external layer, the whole being made solid by means of at least a layer of thermofusible glue, disposed inside said first external layer and second external layer and in coordination with the corresponding layers of parallel fibers.

2. Integral sail as in claim 1, wherein the external layers have a weight comprised between 15 g/m2 and 50 g/m2.

3. Integral sail as in claim 1, wherein said external layers comprise polycarbonate or polypropylene.

4. Integral sail as in claim 1, wherein between the layers of parallel fibers there are reinforcement fibers substantially disposed in order to contrast force lines and in directions of tension which originate during said thrust of wind.

5. Integral sail as in claim 1, and further comprising a multilayer sandwich defined by the overlapping of two components each consisting of said external layers, at least one layer of parallel fibers, at least one layer of thermofusible glue, and of reinforcement fibers, and in that said sandwich is configured to generate said integral structure by means of pressure and heating of said sandwich.

6. Integral sail as in claim 1, and further comprising one or more second layers of parallel fibers.

7. Integral sail as in claim 1, wherein each layer of parallel fibers consists of a panel of one-directional fabric formed by said parallel fibers.

8. Integral sail as claim 1, wherein each layer of parallel fibers is formed by strips of one-directional and parallel fibers disposed parallel and adjacent to each other.

9. Integral sail as in claim 8, wherein said strips of one-directional and parallel fibers are at intervals with one another.

10. Integral sail as in claim 8, wherein said strips of one-directional and parallel fibers are laid above the first external layer and the second external layer.

11. Integral sail as in claim 8, wherein said strips of one-directional and parallel fibers are disposed at an interval chosen between 0 mm and 20 mm.

12. Integral sail as in claim 8, wherein said strips of one-directional and parallel fibers have a width chosen between 5 mm and 50 mm.

13. Integral sail as in claim 8, wherein said strips of one-directional and parallel fibers are formed of synthetic a material chosen from a group comprising: carbon, aramid, for example Kevlar®, polyethylene, for example UHM-WPE, modified polyethylene, glass, polyester.

14. Integral sail as in claim 8, wherein each of said strips of one-directional and parallel fibers is formed by one-directional and parallel threads disposed adjacent directly in contact with each other, without intervals.

15. Integral sail as in claim 8, wherein the sail is integrated inside one or more meshes or nets, and wherein the meshes or nets are reinforced with nonwoven fabric.

16. Integral sail as in claim 1, wherein the integral layered structure has a wing shape with a curved internal profile held by the thermofusible glue.

17. Integral sail to generate a propulsion following a thrust from the wind, comprising: an integral layered structure delimited externally by a first external layer and by a second external layer, both made with a smooth layer of thin and continuous film of flexible material, and in that to each of said first external layer and second external layer at least a first layer of parallel fibers, adjacent to each other, is associated internally with respect to said layered structure, wherein at least the first layer of parallel fibers cooperating with the first external layer provides its fibers disposed parallel also to the fibers of another layer of parallel fibers cooperating with the first external layer and parallel to the fibers of the first layer of parallel fibers cooperating with the second external layer, the whole being made solid by means of at least a layer of thermofusible glue, disposed inside said first external layer and second external layer and in coordination with the corresponding layers of parallel fibers, wherein between the layers of parallel fibers there are reinforcement fibers substantially disposed at an angle relative to the layers of parallel fibers; and a multilayer sandwich defined by the overlapping of two components each comprising said first and second external layers and the associated layers of parallel fibers, and in that said sandwich is formed into an integral structure by means of pressure and heating.

18. Integral sail to generate a propulsion following a thrust from the wind, comprising: an integral layered structure delimited externally by a first external layer and by a second external layer, both made with a smooth layer of thin and continuous film of flexible material, and in that to each of said first external layer and second external layer at least a first layer of parallel fibers, adjacent to each other, is associated internally with respect to said layered structure, wherein at least the first layer of parallel fibers cooperating with the first external layer provides its fibers disposed parallel also to the fibers of another layer of parallel fibers cooperating with the first external layer and parallel to the fibers of the first layer of parallel fibers cooperating with the second external layer, the whole being made solid by means of at least a layer of thermofusible glue, disposed inside said first external layer and second external layer and in coordination with the corresponding layers of parallel fibers;

wherein each layer of parallel fibers is formed by strips of one-directional and parallel fibers disposed parallel and adjacent to each other, wherein said strips of one-directional and parallel fibers are at intervals with one another, are laid above the first external layer and the second external layer, are disposed at an interval chosen between 0 mm and 20 mm and have a width chosen between 5 mm and 50 mm.

19. Integral sail to generate a propulsion following a thrust from the wind, comprising: an integral layered structure delimited externally by a first external layer and by a second external layer, both made with a smooth layer of thin and continuous film of flexible material, and in that to each of said first external layer and second external layer at least a first layer of parallel fibers, adjacent to each other, is associated internally with respect to said layered structure, wherein at least the first layer of parallel fibers cooperating with the first external layer provides its fibers disposed parallel also to the fibers of another layer of parallel fibers cooperating with the first external layer and parallel to the fibers of the first layer of parallel fibers cooperating with the second external layer, the whole being made solid by means of at least a layer of thermofusible glue, disposed inside said first external layer and second external layer and in coordination with the corresponding layers of parallel fibers;

wherein each layer of parallel fibers is formed by strips of one-directional and parallel fibers disposed parallel and adjacent to each other, and wherein said strips of one-directional and parallel fibers are formed of a material chosen from a group comprising: carbon, aramid, polyethylene, modified polyethylene, glass, polyester.

20. Integral sail to generate a propulsion following a thrust from the wind, comprising:

a first external layer having an external surface and an inwardly facing inner surface, the first external layer comprised of a film of flexible material;

a first glue layer deposited on the inner surface of the first external layer;

a first layer of parallel fibers disposed adjacent the first glue layer;

a second glue layer disposed inwardly relative to the first layer of parallel fibers;

a second layer of parallel fibers disposed inwardly relative to the second glue layer;

wherein fibers of the first and second layers of parallel fibers are oriented substantially parallel to one another; and wherein the foregoing layers form an integral sandwich structure upon application of heat and pressure.

21. The integral sail of claim 20, further comprising:

a second integral sandwich structure; and a reinforcement layer disposed between the first and second integral sandwich structure and comprising parallel fibers; and wherein the parallel fibers of the reinforcement layer are disposed non-parallel and non-perpendicular to the parallel fibers of the first and second sandwich structures.

* * * * *